US006823550B2

(12) United States Patent
Kantro

(10) Patent No.: US 6,823,550 B2
(45) Date of Patent: Nov. 30, 2004

(54) DEVICES AND METHODS FOR ORTHOTIC CUSTOMIZATION

(76) Inventor: Scott R. Kantro, 23 Split Rock Rd., Pound Ridge, NY (US) 10576

( * ) Notice: Subject to any disclaimer, the term of this patent is extended or adjusted under 35 U.S.C. 154(b) by 0 days.

(21) Appl. No.: 10/051,398

(22) Filed: Oct. 29, 2001

(65) Prior Publication Data

US 2003/0079303 A1 May 1, 2003

(51) Int. Cl.[7] ..... A43B 3/24; A43B 13/20
(52) U.S. Cl. ..... 12/142 N; 36/44; 36/88
(58) Field of Search ..... 36/43, 44, 88, 36/91, 93; 12/142 N, 146 M; 382/111

(56) References Cited

U.S. PATENT DOCUMENTS

| | | | | | |
|---|---|---|---|---|---|
| 3,968,577 | A | | 7/1976 | Jackson | 36/43 |
| 4,503,576 | A | | 3/1985 | Brown | 12/146 |
| 4,603,698 | A | * | 8/1986 | Guttmann Cherniak | 36/162 |
| 4,604,807 | A | | 8/1986 | Bock et al. | 33/3 |
| 4,745,290 | A | | 5/1988 | Frankel et al. | 250/560 |
| 4,841,648 | A | * | 6/1989 | Shaffer et al. | 36/43 |
| 5,128,880 | A | | 7/1992 | White | 364/550 |
| 5,138,774 | A | * | 8/1992 | Sarkozi | 36/164 |
| 5,164,793 | A | | 11/1992 | Wolfersberger et al. | 356/376 |
| 5,170,572 | A | * | 12/1992 | Kantro | 36/43 |
| 5,216,594 | A | | 6/1993 | White et al. | 364/403 |
| 5,345,701 | A | * | 9/1994 | Smith | |
| 5,640,779 | A | | 6/1997 | Rolloff et al. | 33/514.2 |
| 5,714,098 | A | * | 2/1998 | Potter | 264/40.1 |
| 5,790,256 | A | | 8/1998 | Brown et al. | 356/376 |
| 5,799,414 | A | * | 9/1998 | Kellerman | 36/44 |
| 5,941,835 | A | | 8/1999 | Sundman | 600/592 |
| 6,000,147 | A | * | 12/1999 | Kellerman | 36/44 |
| 6,029,358 | A | | 2/2000 | Mathiasmeier et al. | 33/3 |
| 6,098,319 | A | * | 8/2000 | Epstein | 36/159 |
| 6,105,283 | A | * | 8/2000 | Park | 36/159 |
| 6,141,889 | A | | 11/2000 | Baum | 36/140 |
| 6,160,264 | A | | 12/2000 | Rebiere | 250/559 |
| 6,163,971 | A | | 12/2000 | Humphries, Jr. et al. | 33/515 |
| 6,170,177 | B1 | | 1/2001 | Frappier et al. | 36/142 |
| 6,331,893 | B1 | | 12/2001 | Brown et al. | 356/601 |
| 6,408,543 | B1 | * | 6/2002 | Erickson et al. | 36/100 |
| 6,463,351 | B1 | | 10/2002 | Clynch | 700/163 |
| 2001/0020222 | A1 | | 9/2001 | Lee et al. | 702/155 |
| 2002/0038263 | A1 | | 3/2002 | Massen | 705/27 |
| 2002/0071597 | A1 | | 6/2002 | Ravitz et al. | 382/111 |
| 2002/0138923 | A1 | | 10/2002 | Shafeeullah | 12/142 |

OTHER PUBLICATIONS

Orthotictechnicians.com "A comparative study of hte Pdodtrack", 1999 British Diabetic Association, Diabetic Medicine (pp. 154–159).*

(List continued on next page.)

*Primary Examiner*—M. D. Patterson
(74) *Attorney, Agent, or Firm*—Sofer & Haroun, LLP

(57) ABSTRACT

Bi-level methods of customizing orthotics are provided. In a first level of customization, orthotics are selected based upon the needs and personal characteristics of an individual. In a second level of customization, inserts are added to the orthotics based upon at least the individual's foot type.

20 Claims, 9 Drawing Sheets

OTHER PUBLICATIONS

Edge marketing Company Overview, source, FAQ.
Shoe Tip Articles, source: Eneslow.
Optimizing orthotic designs with FEA, source: Adams.
Down The Road in Orthotic Automation by Edwin Black, Desk Reference Feb. 1996, vol. III, No. 2.
Measuring in shoe pressures to help predict underfoot comfort, Satra Bulletin Jan. 1992.
The Effect of Foot Orthoses on Transverse Tibial Rotation During Walking by McPoil, et al., Journal of the American Podiatric Medical Association, vol. 91, No. 10, Nov./Dec. 2001.
MGT–Medical Gait Technology B.V. , Patent No. 93015090.
Biomechanics of the Normal and Abnormal Foot by Kevin A. Kirby, DPM, vol. 90, No. 1, Jan. 2000.

Foot Type Biomechanics, Comparison of Planus and Rectus Foot Types by Song, et al.; Journal of the American Podiatric Medical Association, vol. 86, No. 1, Jan. 1996.

The Effect of Customized Insoles on the Reduction of Postwork Discomfort by Sobel, et al.; vol. 91, Nov./Dec. 10.

The Normal Foot by Robert D. Phillips; Journal of the American Podiatric Medical Association, vol. 90, No. 7, Jul./Aug. 2000.

* cited by examiner

FIG. 18

| SIZE | A | B | C | D | E | F | |
|---|---|---|---|---|---|---|---|
| | | | | | | | |
| | | | | | | | |
| | WAAI | WBAI | WCAI | WDAI | | | 1801 |
| | WAAII | WBAII | WCAI I | WDAI I | | | |
| | WABI | WBBI | WCBI | WDBI | | | |
| | WABII | WBBII | WCBII | WDBII | | | 1870 |
| | WACI | WBCI | WCCI | WDCI | | | |
| | WACII | WBCII | WCCI I | WDCI I | | | |
| | | | | | | | |
| | | MBAI | MCAI | MDAI | MEAI | MFAI | 1810 |
| | | MBAII | MCAII | MDAII | MEAII | MFAII | |
| | | MBBI | MCBI | MDBI | MEBI | MFBI | |
| 1870 | | MBBII | MCBII | MDBII | MEBII | MFBII | |
| | | MBCI | MCCI | MDCI | MECI | MFCI | |
| | | MBCII | MCCII | MDCII | MECII | MFCII | |

* Higher utilization percentages

COMPONENT LEGEND #36

SEX W = Women M = Men

| | | | |
|---|---|---|---|
| Size: **A** | (3-6.5) | | |
| Size: **B** | (7-8.5) | (5-6.5) | |
| Size: **C** | (9-10.5) | (7-8.5) | |
| Size: **D** | (11-12) | (9-10.5) | 1802 |
| Size: **E** | | (11-13) | |
| Size: **F** | | (14-17) | |

FOOT TYPE GUIDE

| | | |
|---|---|---|
| Planus | **A** | |
| Neutral | **B** | 1803 |
| Cavus | **C** | |

WOMEN'S WEIGHT GUIDE

| | | |
|---|---|---|
| Grade **I** | 75-150 | |
| Grade **II** | 150-200+ | 1804 |

MEN'S WEIGHT GUIDE

| | | |
|---|---|---|
| Grade **I** | 100-175 | |
| Grade **II** | 175-250+ | 1814 |

DEVICES AND METHODS FOR ORTHOTIC CUSTOMIZATION

CROSS-REFERENCE TO RELATED APPLICATIONS

Not Applicable.

STATEMENT REGARDING FEDERALLY SPONSORED RESEARCH

Not Applicable.

FIELD OF THE INVENTION

This invention relates generally to customized orthotic devices that are sometimes referred to as insoles and footbeds and to methods for customizing such orthotics.

BACKGROUND OF THE INVENTION

Orthotic devices ("orthotics") are placed into footwear in order to provide comfort, stabilization, shock absorption, and in order to correct biomechanical imbalances. Orthotics may be prescribed to a patient at "a point of care" location by medical personnel such as podiatrists, orthopedic specialists, pedorthists and chiropractors. Alternatively, these devices may be purchased by consumers at a "point of sale" location such as a pharmacy or a foot apparel store.

The majority of orthotic devices obtained by patients through "point of car" locations are customized. The customization process traditionally commences by obtaining accurate representations of each foot of the patient. Historically, this has been accomplished by taking impressions of the feet in either foam or plaster. Technological advances have now facilitated the electronic imaging of a patient's feet. After foot impressions or images are obtained, they are forwarded to a manufacturer. The manufacturer then constructs customized orthotics for the patient. The resulting orthotics are then sent either directly to the patient or to the "point of care" location for placement into footwear.

To date, the customization of orthotics has not been optimized. For many individuals, the cost of these devices, ranging between $150–500, is prohibitive. This price generally does not include the additional cost of associated office visits. There is a common conception that customized foot beds represent a luxury item. Some or all of the cost of customized orthotics is not covered or defrayed by a patient's insurance or third party payment plan. Further, the majority of manufactured orthotics are not properly sized to the exact dimension of the footwear into which they will be used, thereby producing a less than beneficial result for the user.

Consumers who directly purchase "over the counter" insoles are also confronted with a number of problems. The products offered at such locations, although available at fairly inexpensive prices that range between $5 and $50 per set of foot beds, usually do not provide the benefits associated with customized orthotics. To insure that "over-the counter" products may be purchased by as wide of a range of consumers as possible, the only customized aspect of such foot beds is the shoe size with which they correspond.

A need exists for customized orthotics and for methods to efficiently and inexpensively customize foot beds tailored to the needs, characteristics, and foot geometry of any wearer.

SUMMARY OF THE INVENTION

Customized orthotics, as well as methods to efficiently and inexpensively customize such foot beds so that they are tailored to the specific needs, characteristics, and foot geometry of any wearer, are provided by aspects of the present invention.

Bi-level methods for customizing orthotics are provided. Most generally, the first level of customization tailors orthotics to suit the needs and personal characteristics of the individual, while the second level of customization adds inserts to those orthotics in order to suit the individual's foot geometry.

In an exemplary customization method according to the present invention, an employee at a point of sale location obtains personal data about a customer. The employee then consults reference material to select appropriate orthotics for this customer based on his or her personal data. The employee then obtains a representation of the customer's foot. This representation is then compared against reference material to determine the customer's foot type, based on which the employee then selects inserts for each of the customer's orthotics. The inserts are added to the orthotics, which, in turn, may be placed into a customer's footwear. Preferably, the employee obtains an ink-based representation of the customer's foot using equipment such as an ink-maintaining unit and ink-imprinting sheets. Preferably, the footwear into which the orthotics are to be placed, is designed to readily accept the orthotics with minimal adjustment or follow-up procedures.

BRIEF DESCRIPTION OF THE DRAWINGS

The invention will be more fully understood from the following detailed description taken in conjunction with the accompanying drawings, in which:

FIG. 18 depicts a matrix that an employee consults to depict matrices that an employee at a point of sale location consults to select orthotics for the customer based on that customer's personal data.

DETAILED DESCRIPTION OF THE DRAWINGS

Figure 1:
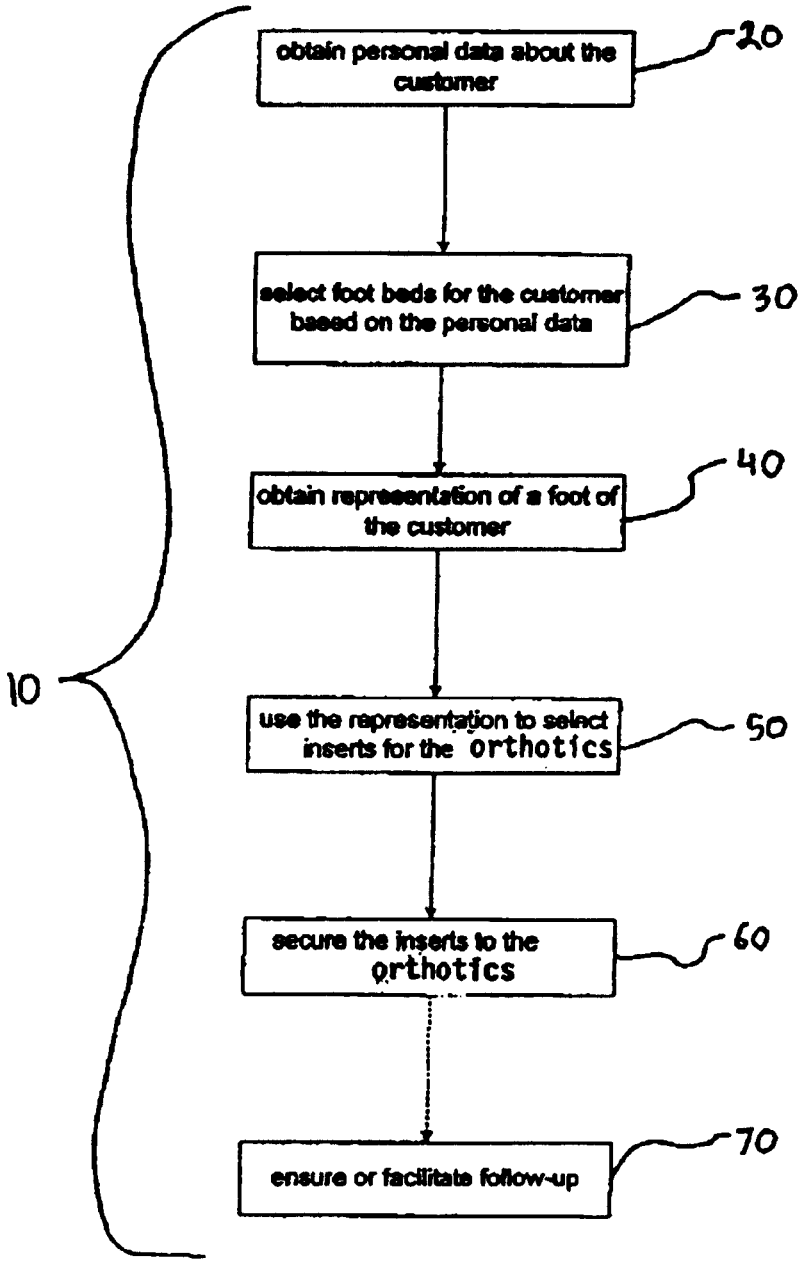
FIG. 1 is a flow diagram depicting a process for customizing orthotics at a point of sale location.

FIG. 1 depicts a flow diagram 10 representing the method of creating customized orthotics at a point of sale location. This is a bi-level customization process in which the first level of customization (steps 20 and 30) tailors orthotics suited to the needs and personal characteristics of the customer, while the second level of customization (steps 40–60) adds composite inserts for the orthotics that suit the geometry of the customer's feet. The term "point of sale location" is used herein to encompass any location at which any type of footwear, foot apparel and/or foot-related products are sold or can be ordered. Exemplary point of sale locations include, but are not limited to, shoe stores, sporting goods stores, department stores, boutiques, and pharmacies. It is also understood that a "point of care location," such as a hospital or a medical office, may also be a point of sale location if that location also sells footwear, foot apparel and/or foot-related products. At step 20, a customer provides personal data about him or herself to an individual associated with a point of sale location (hereinafter, "the employee"). The purpose of this data is to enable the employee to select orthotics that suit the needs and personal characteristics of that particular customer. This data can include, but is not limited to, the sex of the customer, the weight of the customer, the shoe size of the customer's feet, and the type of shoe in which the customer will place his or her finished orthotics. It is understood that the point of sale location may possess equipment suitable to measure the customer's shoe size and/or weight. It is also understood that the point of sale location may opt to maintain one, some or all of the components of the customer's personal data for future reference.

Figure 2:
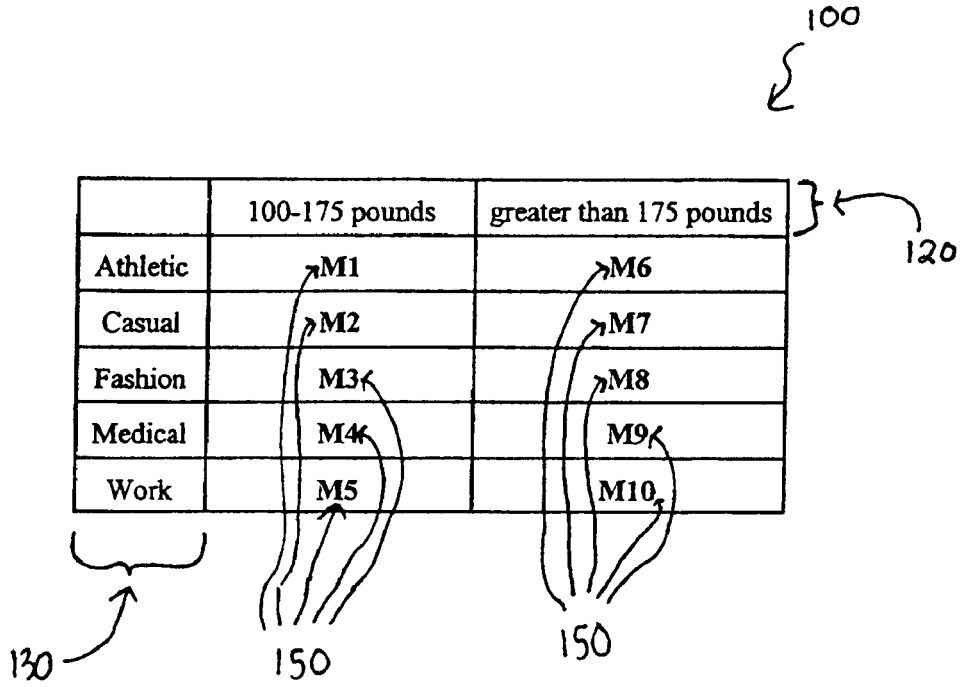
FIGS. 2–3 depict matrices that an employee at a point of sale location consults to select orthotics for the customer based on that customer's personal data.
Figure 3:
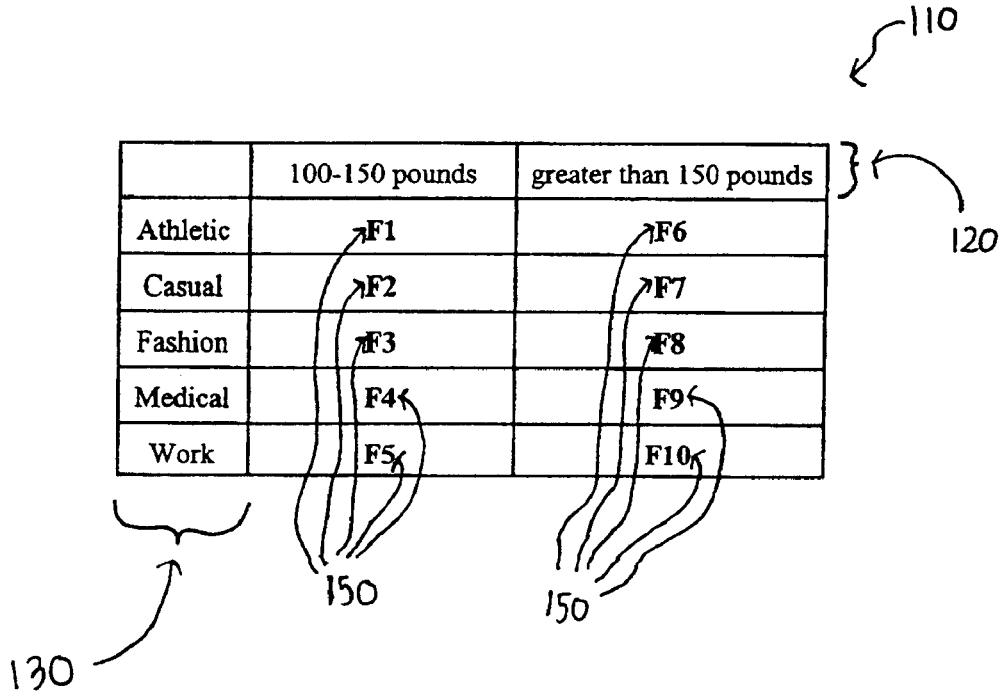

At step 30 of the method, the employee selects at least one set of orthotics (i.e., at least one left-footed orthotic and at least one right-footed orthotic) for the customer based on one, some, or all of these personal data components. To guide this step of the process, the point of sale location is equipped with a reference system that the employee may consult to ensure the selection of orthotics that properly match the consumer's personal data components. Examples of such reference systems are depicted in FIGS. 2, 3, and 18. It will be understood that these examples in no way limit the scope of the methodology disclosed herein.

In an embodiment of the present invention, the point of sale location's reference system is based upon printed materials, such as printed copies of the matrices shown in FIGS. 2 and 3. FIG. 2 depicts a matrix 100 for male customers, while FIG. 3 depicts a matrix 110 for female customers. Each matrix 100, 110 assigns an alpha-numeric code 150 to one, some, or all of the customer's personal data components. In the exemplary embodiment of FIGS. 2 and 3, this code 150 is based on the weight of the customer (the horizontal data area 120 of the matrices 100, 110) and the type of shoe in which the customer is going to place his or her orthotics (the vertical data area 130 of the matrices 100, 110).

Using these exemplary matrices 100, 110, an employee can deduce the code 150 corresponding to the personal data of any customer. For example, if a customer is a male who weighs 270 pounds, and who is interested in purchasing orthotics to wear in work boots, the employee would consult male matrix 100 to match the customer's personal data to the "M10" code that corresponds to work shoes for males who weigh greater than 175 pounds. If, instead, a customer is a female who weighs 140 pounds, and who is interested in purchasing orthotics to wear in fashion-type shoes, the employee would consult matrix 110 to match the customer's personal data to the "F3" code that corresponds to fashion shoes for females who weigh between 100 and 150 pounds.

The matrices 100, 110 of FIGS. 2 and 3 are illustrative, non-limiting examples of a reference system based on printed materials. One of ordinary skill in the art will readily appreciate that the printed materials may be other types of pictorial, textual, or partially-pictorial and partially-textual printed materials. Moreover, the code 150 used to match the customer's personal data to specific orthotics need not be alpha-numeric; for example, the code may instead be entirely numeric or entirely alphabetic.

One of ordinary skill in the art will also readily appreciate that the number, content, format and presentation of these matrices 100, 110 may vary without undue experimentation and without departing from the scope of the invention. For example, although the matrices 100, 110 of FIGS. 2 and 3 depict two weight ranges in their horizontal data areas 120, it is understood that the number of weight ranges may be greater than, or fewer than, two. Moreover, the weight ranges indicated in the horizontal data area 120 of the matrices 100, 110 may be narrowed or widened from the illustrated ranges. Also, the weight ranges need not be indicated in pounds, but may instead be indicated in any weight measurement system, e.g., kilograms or stones.

An example of a somewhat more comprehensive reference system or "prescription matrix" is illustrated in FIG. 18. Matrix 1800 combines a 6×6 submatrix 1801 containing women's prescription data with a 6×6 submatrix 1810 containing men's data. The data of submatrix 1801 categorizes six "size ranges" (A–F) 1802, three foot types (A,B,C) 1803 and, as earlier described, two weight ranges (grades I and II) 1804. Similarly, submatrix 1810 charts the same size ranges 1802, foot types 1803 and slightly different weight ranges 1814 for men. As there may be little requirement for the smallest size range A for men, or the largest size ranges E,F for women, no data is shown in matrix 1800 for such prescription combinations or codes 1870.

Additionally, the content of the matrices 100, 110 may be adjusted depending on the inventory of a particular point of sale location. For example, if a point of sale location does not sell each of the five types of shoes indicated in the vertical data area 130 of the matrices 100, 110, the vertical data area could be adjusted to include only those types of shoes which are, in fact, sold at that particular point of sale location. Furthermore, one, some, or all of the shoe type categorizations indicated in the vertical data areas 130 of the matrices 100, 110 may be broadened or narrowed from the five exemplary, illustrated categories. For example, the vertical data area category 130 of "athletic" shoes can be broadened into court shoes, running shoes, cross training shoes, etc., or the five vertical data area categories could be narrowed into simply two categories, e.g., "athletic" and "non-athletic" shoes, and so on.

In another exemplary embodiment of the present invention, the point of sale location's reference system may be entirely or partially computerized. In such an embodiment, either the employee or the customer enters one, some, or all of the components of the customer's personal data into a computer database. This can be accomplished by inputting the data via a keyboard, by inputting the data via voice recognition software, by downloading the data, or by any other entry method known in the art. The computer then processes the entered data as is known in the art, compares the processed data to stored data as is generally known in the art, and then indicates to the employee and/or the customer the code 150 that matches the customer's personal data. This indication can be provided by the computer to the employee or the customer as is generally known in the art, such as via visual (e.g., screen or monitor) display, via sound, or via a printout.

Either before, while, or, preferably, after the employee consults the printed materials and/or the computerized reference system to match the customer's personal data to the code to which it corresponds, the employee obtains the customer's shoe size. This can be accomplished via direct measurement as is known in the art, by questioning the customer, or by having the customer input his or her shoe size into a computer. The employee then selects at least one set of orthotics from the inventory of the point of sale location that matches both the customer's shoe size and the customer's personal data code 150.

Figure 4:
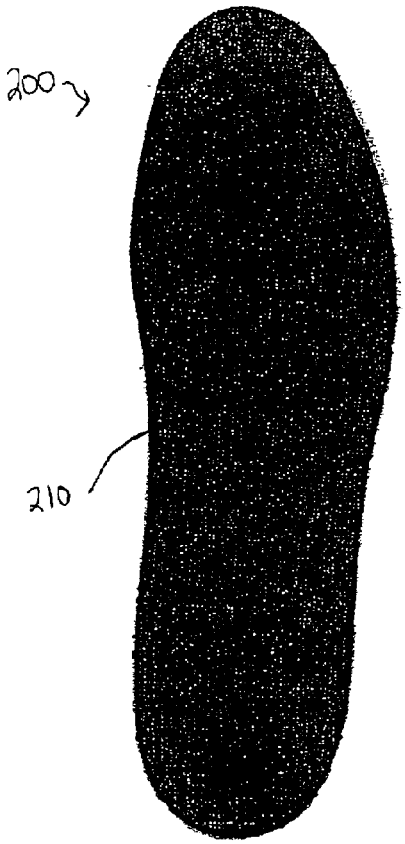
FIG. 4 is a top view of an exemplary orthotic according to the present invention.
Figure 5:
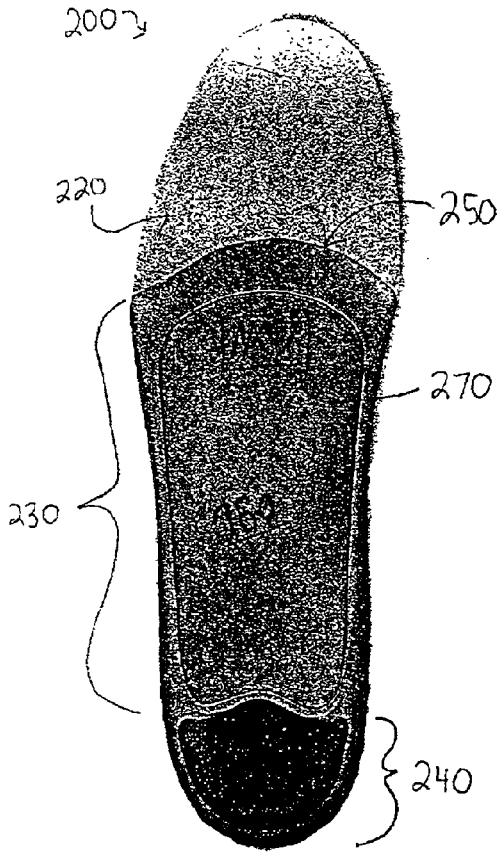
FIG. 5 is a bottom view of the orthotic of FIG. 4.
Figure 6:
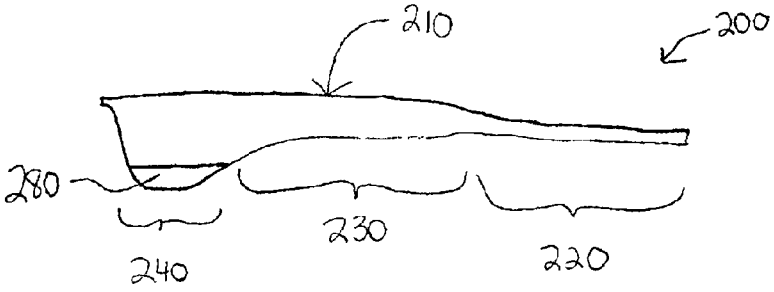
FIG. 6 is a side view of the orthotic of FIG. 4.

An exemplary right-footed orthotic 200 is shown in FIGS. 4–6. As shown in FIG. 4, the superior surface 210 of the orthotic 200 has a shape generally resembling that of orthotics known in the art. As shown in FIGS. 5 and 6, however, the inferior surface of the orthotic 200 differs from conventional orthotics in that it is divided into three distinct regions: a front region 220, a middle region 230, and a heel region 240. Middle region 230 of the orthotic 200 is joined to the front region 220 at a connection zone 250. The middle region 230 also includes a recessed portion 260 for attachment of an insert (examples of inserts 600 are illustrated in FIGS. 13–16). Also, as shown in FIG. 6, the orthotic 200 generally includes a heel pad 260 that is secured to the heel region 240. In a preferred embodiment of the invention, the recessed area 260 of the middle region 230 of the orthotic 200 includes a verification code 270 that corresponds to one of the codes 150 discussed above with respect to FIGS. 2 and 3 (or a code corresponding to one of the prescription combinations of FIG. 18) and that allows the employee to verify that he or she has selected the proper orthotics.

Although not shown, it is understood that the employee would bring the customer at least one complete set of orthotics 200, with each complete set including at least one left-footed and at least one right-footed orthotic. Also, although FIGS. 4–6 solely depict a right-footed orthotic 200, one of ordinary skill in the art will readily appreciate that a left-footed orthotic would generally be a mirror image of the orthotic of FIGS. 4–6. Moreover, although FIGS. 4–6 depict a full-sized orthotic 200 that includes a heel pad 280, one of ordinary skill in the art will readily appreciate that the orthotic could be a smaller orthotic generally known in the art, such as a three-quarter sized orthotic, and/or that the orthotic need not include a heel pad.

In order to achieve further customization of orthotic 200 of FIGS. 4–6, an insert or composite component is added to the recessed portion 260 of the middle region 230 of each orthotic. Whereas the orthotic 200 has been selected (i.e., customized) to suit the customer's personal data, this insert is selected to suit the geometry of the customer's feet, i.e., the customer's foot type.

In order to determine the customer's foot type, the employee obtains a representation (i.e., an image or impression) of the customer's foot; this is done at step 40 of the process of FIG. 1. In order to serve the interests of both the customer and the point of sale location, the process of obtaining this representation should be inexpensive, pain free to the customer, should produce little to no mess and require little clean-up, should be performable by one point of sale location employee, and should yield an accurate representation of the customer's foot type in a reasonably quick time (i.e., within minutes).

Figure 7:
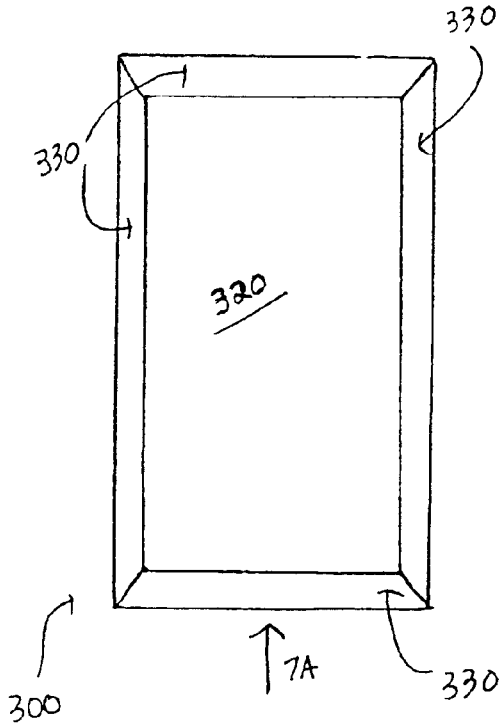
FIG. 7 is a top view of an exemplary ink-maintaining unit that is used to obtain a representation of a customer's foot in accordance with the present invention.
Figure 7A:
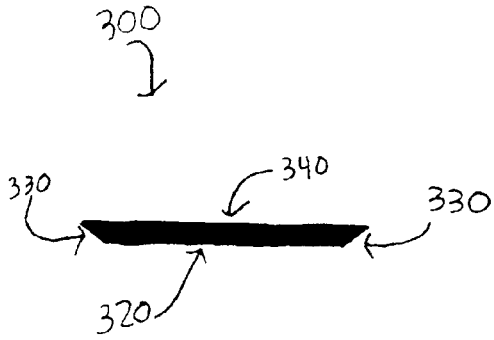
FIG. 7A is side view, viewed in the direction of arrow 7A of FIG. 7, of the ink-maintaining unit of FIG. 7.
Figure 8:
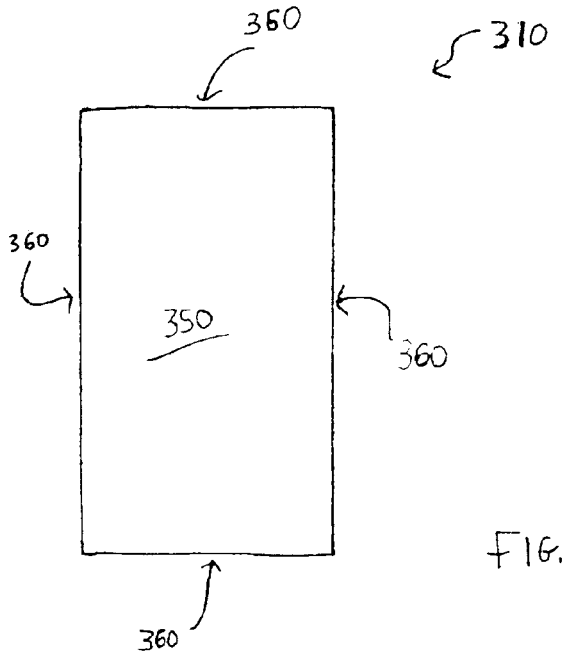
FIG. 8 is a top view of an imprinting sheet that is also used to obtain a representation of a customer's foot in accordance with the present invention.

In an exemplary embodiment of the present invention that serves each of these interests, the employee obtains an ink-based or carbon representation of one of the customer's feet in order to determine the customer's foot type. FIG. 7 depicts equipment used to obtain such a representation. This equipment is available from a variety of manufacturers, such as Acor® Orthopaedic, Inc. of Cleveland, Ohio. The equipment includes an ink-maintaining unit 300 and at least one imprint sheet or strip 310. Preferably, the ink-maintaining unit 300 has a receptacle 320 that, as shown in FIG. 7A, is substantially flat and that is separated from the open, superior surface 340 of the unit by walls 330.

The imprint sheet 310 has a shape generally resembling that of the receptacle 320 of the ink-maintaining unit 300, but has dimensions that allow the sheet to lie flat on the receptacle without contacting any of the walls 330 thereof. The dimensions of the sheet or strip 310 should also allow an adult male or female customer to place his or her foot on the superior surface 350 of the sheet without any portion of that foot protruding across any of the sides 360 of the sheet.

Figure 9:
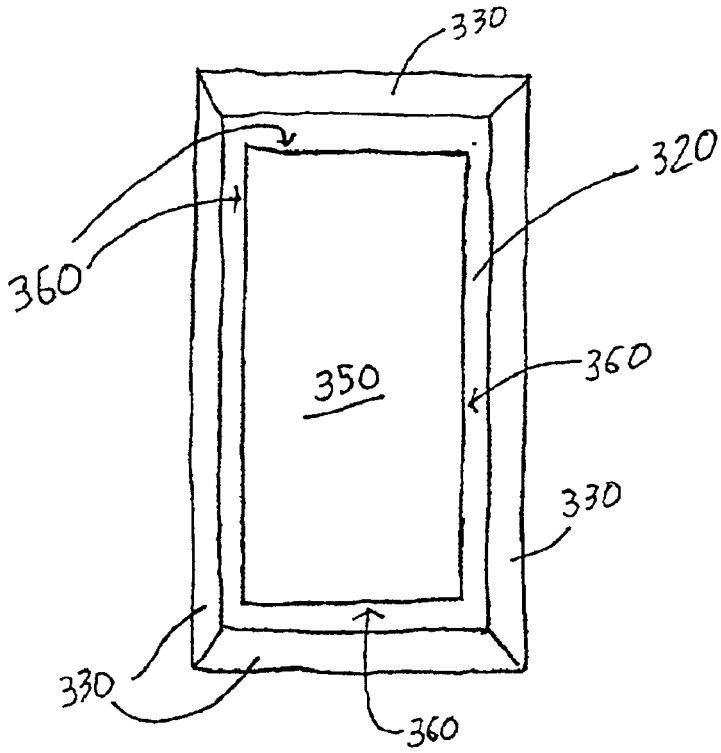
FIG. 9 is a top view of the imprinting sheet of FIG. 8 after its placement in the receptacle of the ink-maintaining unit of FIG. 7.
Figure 10:
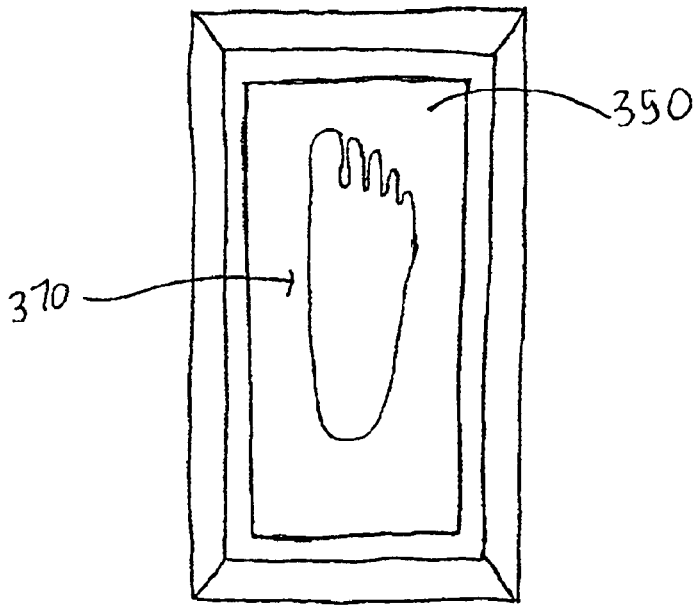
FIG. 10 is a top view of the equipment of FIG. 9 while a representation of a customer's foot is being obtained.

In use, the employee coats the receptacle 320 of the unit 300 with ink (not shown) as needed. Following proper placement of the sheet on the ink-holding receptacle (see FIG. 9), the customer then steps on the superior surface 350 of the sheet with one of his or her feet 370 as shown in FIG. 10. The customer then removes his or her foot 370, which is free from ink due to the presence of the sheet between the customer's foot and the ink-holding unit 300. The employee then removes the sheet, which will now depict an ink-imprinted representation (see FIG. 11) of the customer's foot on the inferior surface of the sheet.

One of ordinary skill in the art will readily appreciate that although it is possible to repeat the above-indicated steps to obtain a representation of the customer's other foot, it is generally unnecessary to do so because although one's feet may vary in size and/or width, they generally do not vary in type.

Once the employee has obtained an ink-imprinted representation 400 (see FIG. 11) of the customer's foot, the process of FIG. 1 continues to step 50 wherein the employee uses the representation to deduce the customer's foot type, and then obtains inserts for the customer's foot beds 200 (see FIGS. 4–6) based the customer's foot type. Because employees of point of sale locations generally are not trained to recognize different foot types, the point of sale location will possess reference material against which the ink-imprinted representation 400 of the customer's foot may be compared in order to determine the customer's foot type, and, in turn, to select the proper inserts to suit that foot type.

Figure 12:
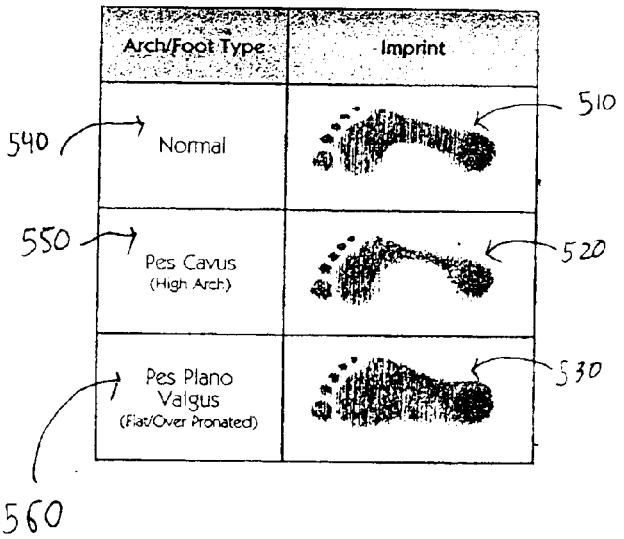
FIG. 12 is an exemplary reference chart to assist in matching the representation of FIG. 11 with a particular foot type.
Figure 13:
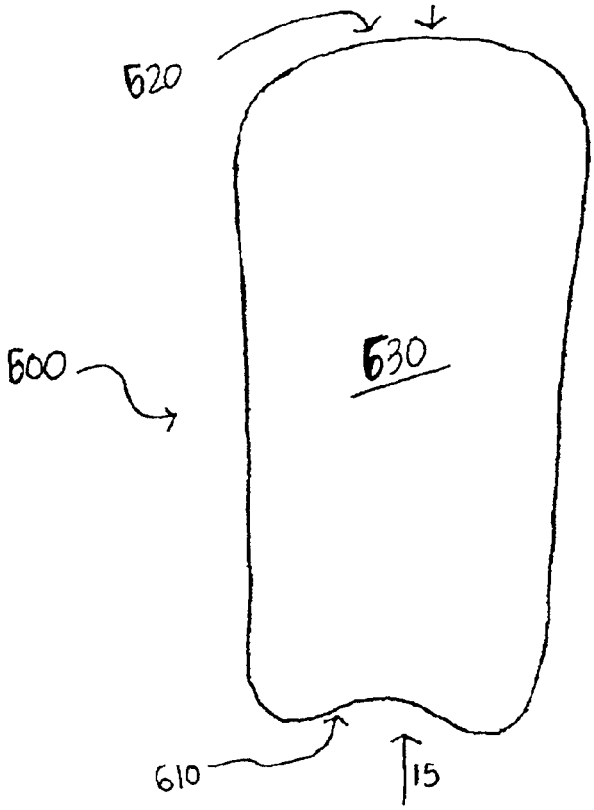
FIG. 13 is a top view of an exemplary embodiment of a orthotic insert according to the present invention.

In an exemplary embodiment of the present invention, the point of sale location possesses reference material similar to the chart 500 of FIG. 12. That chart 500 matches three types of feet—normal, pes cavus (i.e., high arch), and pes plano valgus (i.e., low arch or flat/over pronated)—to imprints 510, 520, 530 that each of these types of feet would produce via an ink-imprinting process similar to that described above with respect to FIGS. 7–10.

Specifically, the employee visually inspects the customer's representation 400 and compares it to the illustrative imprints 510, 520, 530 that would be produced by each of the types of feet included within the chart 500. Once the employee satisfactorily matches the representation 400 to one of the illustrative imprints 510, 520, 530, he or she then references the foot type description 540, 550, 560 within the chart 500 that corresponds to that particular illustrative imprint (normal, pes cavus and pes plano valgus) in order to determine the customer's foot type.

Figure 11:
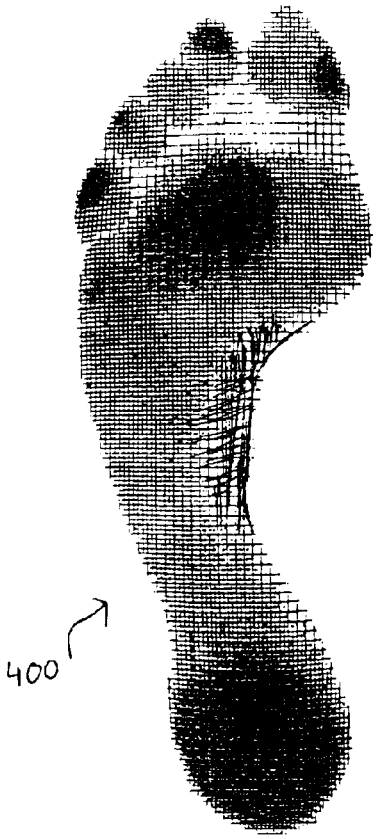
FIG. 11 is a schematic representation of a customer's foot.

For example, the employee would note that the representation 400 of FIG. 11 most closely resembles the illustrative imprint 510 in the chart 500. The employee would then further reference the chart 500 to deduce that the imprint 510 is illustrative of a representation that would be produced by a neutral type of foot, which, therefore, is the customer's foot type.

One of ordinary skill in the art will readily appreciate that the reference material need not be identical to the chart 500 of FIG. 12. Acceptable reference materials may be other types of textual, pictorial or partially-textual and partially-pictorial materials. One of ordinary skill in the art will also readily appreciate that in the event that the employee is unable to determine the customer's foot type via the representation 400, the employee should repeat step 40 of the process of FIG. 1 to obtain at least one additional representation of the customer's same, or other, foot.

Moreover, one of ordinary skill in the art will further appreciate that although the chart of FIG. 12 depicts three types of feet, it is understood that a foot type classification system in accordance with the present invention may be based upon greater than or fewer than the three illustrated types 540, 550, 560 of feet and/or may be based on additional or entirely different classifications. Among other exemplary foot type classifications are medial (where the points of highest pressure on the ink prints are located medially), medial/central (where there is equal pressure across the first and second metatarsal heads), central (where the points of highest pressure are located centrally at the second and/or third metatarsal heads) and central/lateral (where there are points of high pressure at the central and lateral points and low pressure at the first metatarsal head).

Once the employee has determined a customer's foot type via the representation of FIG. 11 and the chart of FIG. 12, the employee has the requisite information to select the proper inserts or composite components to be placed within the customer's previously-selected orthotics. In an exemplary embodiment of the present invention, the point of sale location possesses inserts or composite components that correspond to each of the codes 150 indicated in the matrices of FIGS. 2 and 3 and that correspond to each of the foot types 540, 550, 560 indicated in the chart of FIG. 12.

Figure 14:
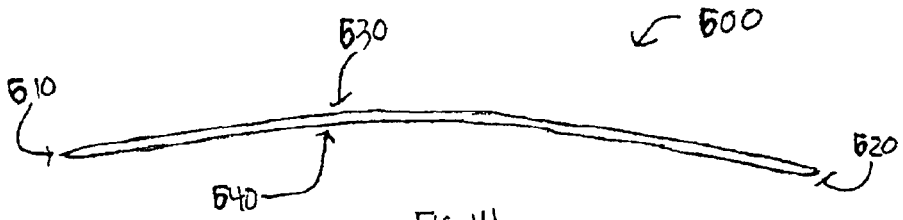
FIG. 14 is a side view of the orthotic insert of FIG. 13.
Figure 15:
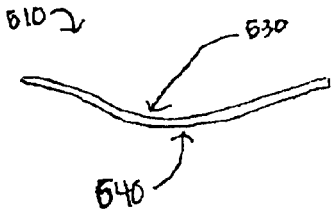
FIG. 15 is an end view, in the direction of arrow 15 of FIG. 13, of the insert of FIG. 13.
Figure 16:
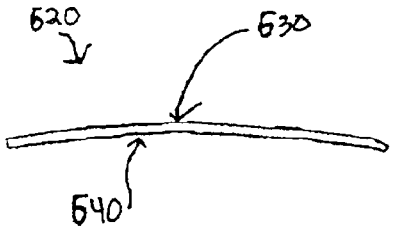
FIG. 16 is an end view, in the direction of arrow 16 of FIG. 13, of the insert of FIG. 13.

FIGS. 13–16 depict an exemplary insert 600 in accordance with the present invention. The insert 600 has a proximal end 610 and a distal end 620, a superior surface 630, and an inferior surface 640. As shown in FIG. 14, the insert 600 has a curved contour, with its proximal end 610 (see FIG. 15) being concave and its distal end 620 (see FIG. 16) being convex. One of ordinary skill in the art will readily appreciate, however, that the shape of the insert 600 may vary from that which is depicted in FIGS. 13–16 without departing from the scope of the invention.

Figure 17:
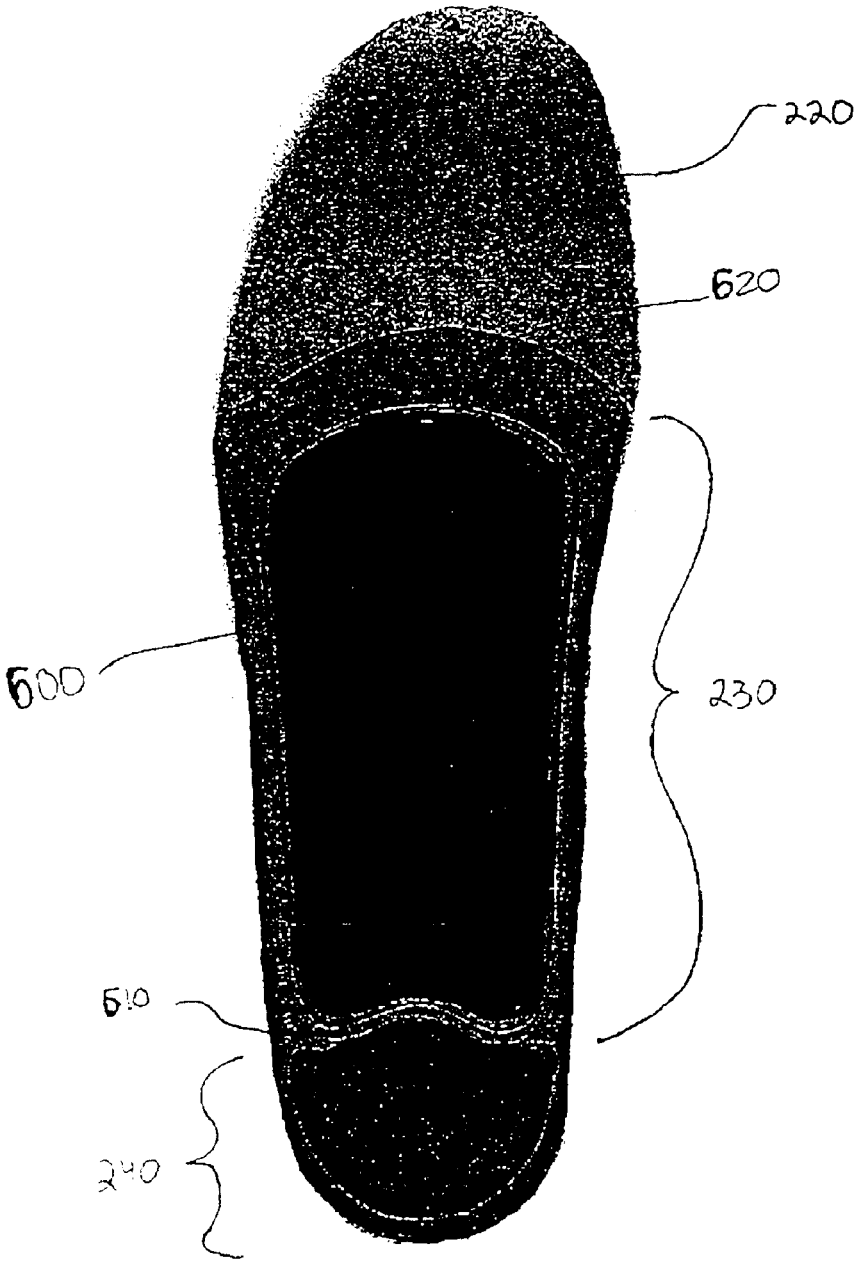
FIG. 17 is a bottom view of a finished orthotic according to the present invention.

The insert 600 has a curved contour in order to fit against the recessed area 260 of the middle region 230 of the orthotic (see FIG. 5). FIG. 17 depicts the inferior surface of the orthotic of FIG. 5 with the insert 600 of FIG. 13 having been fit into the recessed area 260 of the middle region 230 of the orthotic. To achieve this fit, the top surface 630 of the insert 600 is placed against the recessed area 260 of the middle region 230 of the orthotic such that the proximal end 610 of the insert is in proximity to the heel region 240 of the orthotic, while the distal end 620 of the insert or composite component is in proximity to the front region 220 of the orthotic.

At step 60 of the process of FIG. 1, insert 600 is secured to the recessed area 260 of the middle region 230 of each orthotic. The insert 600 may be secured to the orthotic by an adhesive or a glue. Once the insert 600 is properly secured to the orthotic, the orthotic becomes a "finished orthotic" and is suitable for placement in a customer's shoe.

Both insert 600 and the orthotic may be made of a variety of materials. For example, insert 600 may be made from a graphite composite, polyethylene or any other suitable material to which the principles of biomechanics are not affected by the stress and strain characteristics of the material. The orthotic itself may be made out of polyurethane, ethyl vinyl acetate (EVA) latex, rubber, or any other material that is suitable for placement in footwear as an orthotic device.

Another aspect of this invention pertains to utilizing an orthotic that is an original component of a footwear item. This orthotic may be pre-installed in the shoe, or it may be otherwise associated with the shoe. Such an orthotic includes a cavity formed in its inferior surface, together with a removable plug that occupies the cavity. The cavity may be of a variety of shapes and sizes. Preferably, the cavity shape and size corresponds to an area located substantially from the heel, extending distally to the plantar proximal aspect of the metatarsal heads. The plug can be made from a variety of materials; preferably, the plug will be made from a polymeric material such as polyurethane.

When such an orthotic is properly prescribed or recommended for a customer, a customized insert is also prescribed or recommended, based on user data of the type noted above. Thus, when appropriate, the user is able to remove the plug and install the customized insert within the cavity.

Referring again to FIG. 1, the flow diagram 10 includes an optional, yet preferred, step 70 wherein the employee ensures or facilitates the customer's future purchases of orthotics from the point of sale location. In order to do so, the employee will memorialize the customer's personal data, maintain the customer's representation 400 or a copy thereof, and provide the customer with the representation 400 or a copy thereof. Any or all of these may be stored entirely or partially in physical form or in electronic (i.e., computer-accessible) form as is generally known in the art. This would simplify and/or expedite a customer's purchase of additional orthotics from the point of sale location. For example, the customer could return to the point of sale location and either present a copy of the representation of his or her foot, or ask that the point of sale location retrieve its physical or electronic copy of the representation. The point of sale location would then retrieve the customer's personal data and verify that it is still accurate. If any of the components of the customer's personal data are inaccurate, the employee would update those portions.

Then, using this verified personal data and the representation, the employee could supply the customer with finished orthotics according to the process of FIG. 1, but without performing either some or any of step 20 (obtaining personal data about the customer), and without performing any of step 40 (obtaining a representation of the foot of a customer). Instead, the employee merely compares that customer's personal data to the FIG. 2 or FIG. 3 matrices

100, 110 to select the proper orthotics, compares the customer's previously-obtained representation to the chart 500 of FIG. 12 to select the proper inserts or composite components, and then secures the inserts or composite components to the orthotics to construct finished orthotics.

In another embodiment of the present invention, a customer could obtain additional finished orthotics through the use of one or more electronic communications. This would provide the customer with the option of obtaining finished orthotics without actually visiting at the point of sale location.

In one such embodiment, the customer contacts the point of sale location and asks an employee to retrieve his or her personal data. The customer may either verifies or updates over the telephone or other contact medium. The customer then either electronically transmits (e.g., via facsimile or via email, both as is generally known in the art) his or her copy of the representation to the point of sale location or may direct the employee to retrieve the point of sale location's copy of the representation. The employee uses the personal data and the representation in accordance with the process of FIG. 1 to generate as many sets of finished orthotics for the customer as desired. The employee would then mail the finished orthotics to the customer or arrange for the customer to pick up the finished orthotics at the point of sale location.

Additionally, if the point of sale location has a presence (i.e., maintains a web-site) on the global computer network known as the Internet, the customer could arrange with the point of sale location to open an account with the web-site. Generally, this would entail the customer selecting a unique password and having the employee, or another person associated with the point of sale location, upload the customer's personal data and foot type information onto the web-site or otherwise make the data and information accessible via the web-site.

Subsequently, the customer could connect to the web-site and supply his or her unique password, each as is generally known in the art. This information would be processed as is known in the art, and the web-site will retrieve and indicate (e.g., display) the customer's personal data and foot type. The customer would then be able to verify this data, or modify it as required, each as generally known in the art. The user would then submit a request for however many sets of finished orthotics it desires. The web-site would process this request as is generally known in the art and would either automatically charge or bill the customer for the cost of these orthotics (plus any services charges and/or shipping charges) or would prompt the user to supply payment information, e.g., his or her credit card or bank account number. The orthotics would be prepared according to FIG. 1 and then would be mailed to the customer.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A method of customizing an orthotic for an individual, comprising:

providing a set of orthotics and a set of inserts, each of said orthotics having a top and bottom side, said bottom side of said orthitics each maintains a cavity, having a plug fitted therein forming a complete sole for a shoe;

obtaining a representation of a foot of the individual;

determining whether an insert from said set of inserts is needed for the individual; and if an insert is required, selecting an insert from the set of inserts, based on said representation of the foot of the individual, wherein said plug is removed from said cavity in said orthotic and replaced with said selected insert so as to customize the orthotic to the individual.

2. The method of claim 1, wherein each of the steps is performed at an identical physical location.

3. The method of claim 1, further comprising the step of receiving personal data about the individual selecting an orthotic from the set of orthotics, the orthotic tailored to the individual based on the personal data, wherein said personal data is selected from the group consisting of the sex of the individual, the individual's shoe size, the individual's weight, the individual's shoe type, and combinations thereof.

4. The method of claim 3, wherein selecting an orthotic comprises:

consulting a reference system to match the personal data to a code; and using the code to select the orthotic.

5. The method of claim 4, wherein the code is alphanumeric.

6. The method of claim 4, Wherein the personal data includes shoe size, sex and weight.

7. The method of claim 1, wherein obtaining the representation comprises obtaining an impression of the foot.

8. The method of claim 7, wherein the impression is an ink-based impression.

9. The method of claim 8, wherein obtaining the representation further comprises:

placing a predetermined quantity of ink on an ink-maintaining surface;

placing a sheet on the surface; and having the individual place the foot on the sheet while exerting a predetermined downward force.

10. The method of claim 1, wherein selecting an insert includes at least determining the individual's foot type based on the representation.

11. The method of claim 10, wherein the individual's foot type is selected from the group consisting of pes cavus, pes piano valgus, and normal.

12. The method of claim 10, wherein the individual's foot type is determined by:

consulting a reference system that includes a plurality of visual depictions of exemplary representations that would be produced by a plurality of different foot types;

comparing the representation of the individual's foot with each of the exemplary representations; and determining which of the exemplary representations most closely resembles the representation of the individual's foot.

13. The method of claim 1, further comprising:

coupling the insert to the orthotic, coupling performed by securing the insert to an inferior orthotic surface.

14. The method of claim 13, wherein the orthotic includes a recessed area to which the insert is secured.

15. The method of claim 13, wherein the insert is constructed from a graphite composite.

16. The method of claim 13, wherein the insert is secured via an adhesive.

17. A method of customizing an orthotic for an individual in a retail setting, the method comprising:

receiving personal data about the individual, the personal data selected from sex, weight, shoe size, shoe type, and combinations thereof;

selecting an orthotic based on said personal data, said orthotic having an upper and lower surface, said lower surface having a cavity, said cavity having a plug therein:

obtaining an ink-based representation of a foot of the individual;

deducing information pertaining to the individual's foot based on the representation, the information including at least the individual's foot type;

selecting a component based on the individuals foot type; and securing said component to said cavity on said lower side of said orthotic, by removing said plug and securing said component into said cavity.

18. A method of customizing an orthotic for an individual in a retail setting, said method comprising the steps of:

receiving personal data about the individual, the personal data selected from sex, weight, shoe size, shoe type, and combinations thereof;

selecting an orthotic having a removable plug disposed in a cavity formed on its lower surface;

obtaining an ink-based representation of a foot of the individual;

deducing information pertaining to the individual's foot based on the representation, the information including at least the individual's foot type;

removing the plug from the cavity; and securing a component within the cavity; selection of the component based at least upon the individual's foot type.

19. The method of claim 18, wherein the plug is made from polyurethane.

20. The method of claim 18, wherein the cavity is shaped and sized corresponding to an area located substantially from a heel of the foot, extending distally to a plantar proximal aspect of metatarsal heads of the foot.

* * * * *